US009133636B2

(12) United States Patent
Hewlett et al.

(10) Patent No.: US 9,133,636 B2
(45) Date of Patent: Sep. 15, 2015

(54) IMPALEMENT PREVENTION APPARATUS FOR EXTENDING OVERTOP OF AND AROUND THE EXPOSED ENDS OF A PLURALITY OF SPACED-APART REINFORCING BARS

(71) Applicant: 0971065 B.C. Ltd., Delta (CA)

(72) Inventors: Phil Hewlett, Delta (CA); Jim MacLean, Delta (CA)

(73) Assignee: 0971065 B.C. Ltd., Delta (CA)

( * ) Notice: Subject to any disclaimer, the term of this patent is extended or adjusted under 35 U.S.C. 154(b) by 0 days.

(21) Appl. No.: 14/071,389

(22) Filed: Nov. 4, 2013

(65) Prior Publication Data

US 2015/0121785 A1 May 7, 2015

(51) Int. Cl.
*E04G 21/32* (2006.01)
*E04C 5/16* (2006.01)

(52) U.S. Cl.
CPC ..... *E04G 21/3252* (2013.01); *E04C 5/161* (2013.01); *E04C 5/163* (2013.01); *E04G 21/32* (2013.01); *E04C 5/16* (2013.01)

(58) Field of Classification Search
CPC ..... E04C 5/161; E04C 5/16; E04C 5/162; E04C 5/163; E04C 5/168; E04C 5/206; E04C 5/208; E04G 21/32
USPC ..... 52/300, 301; 256/59, 65.12; 138/96 R, 138/117; D25/135; 206/503, 504
See application file for complete search history.

(56) References Cited

U.S. PATENT DOCUMENTS

| | | | | |
|---|---|---|---|---|
| 4,202,378 | A | 5/1980 | Bush et al. | |
| 5,447,290 | A * | 9/1995 | Workman | 256/59 |
| 5,943,836 | A * | 8/1999 | Kassardjian | 52/301 |
| 5,950,680 | A | 9/1999 | Randall | |
| 5,967,322 | A * | 10/1999 | Apps et al. | 206/497 |
| 6,017,014 | A | 1/2000 | Maguire | |
| 6,073,415 | A * | 6/2000 | Carnicle | 52/698 |
| 6,085,478 | A | 7/2000 | Workman | |
| 6,199,333 | B1 * | 3/2001 | Viduka, Jr. | 52/300 |
| 6,662,514 | B2 * | 12/2003 | Workman | 52/300 |
| 7,716,898 | B1 | 5/2010 | Dunn | |
| 7,784,615 | B2 * | 8/2010 | Stahl | 206/511 |
| 2005/0109653 | A1 * | 5/2005 | Wnek et al. | 206/515 |

FOREIGN PATENT DOCUMENTS

CA 1085643 9/1980

OTHER PUBLICATIONS

International Search Report and Written Opinion for PCT/CA2014/051054, dated Mar. 3, 2015.

* cited by examiner

*Primary Examiner* — Brian Glessner
*Assistant Examiner* — Babajide Demuren
(74) *Attorney, Agent, or Firm* — Cameron IP

(57) ABSTRACT

There is provided an impalement prevention apparatus for use with a plurality of spaced-part bars. The apparatus includes an elongate top portion shaped to extend overtop of exposed ends of the bars. The apparatus includes a pair of elongate spaced-apart side portions connecting to the top portion and extending downwards therefrom. The apparatus includes a pair of spaced-apart end portions each connecting to and extending between the side portions. The top portion, the side portions and the end portions form an enclosure extendable around the exposed ends of the bars.

20 Claims, 11 Drawing Sheets

IMPALEMENT PREVENTION APPARATUS FOR EXTENDING OVERTOP OF AND AROUND THE EXPOSED ENDS OF A PLURALITY OF SPACED-APART REINFORCING BARS

FIELD OF THE INVENTION

There is provided an impalement prevention apparatus. In particular, there is provided an impalement prevention apparatus for extending overtop of and around the exposed ends of a plurality of spaced-apart bars.

DESCRIPTION OF THE RELATED ART

U.S. Pat. No. 5,950,680 to Randall discloses an impalement protector for use in shielding protruding concrete reinforcing bars, typically found on construction sites, used to prevent personal injuries caused by persons falling or otherwise coming into contact with the tips thereof. It consists of an elongated U-shaped channel that is formed such that the free ends thereof are drawn together such that the impalement protector slides over the reinforcing bars, creating a friction fit therewith and securing itself thereto.

The above-described prior art may suffer from a number of disadvantages. The majority of people who fall at constructions sites may fall within a distance of ten vertical feet, and thus at an angle relative to the vertical axis. People who fall are thus more likely than not to fall at an angle. When said people fall onto the above-described device at an angle, the device may have a tendency to slide and expose the ends of the bars, thereby increasing the risk of impalement.

The above-described device may be relatively bulky for storage purposes and may be cumbersome to extend overtop of the bars.

There is accordingly a need for an improved impalement prevention device.

BRIEF SUMMARY OF INVENTION

There is provided an impalement prevention apparatus disclosed herein that overcomes the above disadvantages.

There is accordingly provided an impalement prevention apparatus for use with a plurality of spaced-part bars. The apparatus includes an elongate top portion shaped to extend overtop of exposed ends of the bars. The apparatus includes a pair of elongate spaced-apart side portions connecting to the top portion and extending downwards therefrom. The apparatus includes a pair of spaced-apart end portions each connecting to and extending between the side portions. The top portion, the side portions and the end portions form an enclosure extendable around the exposed ends of the bars.

There is also provided an impalement prevention apparatus for use with a plurality of spaced-part bars. The apparatus includes a means for forming an enclosure extendable around the exposed ends of the bars.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
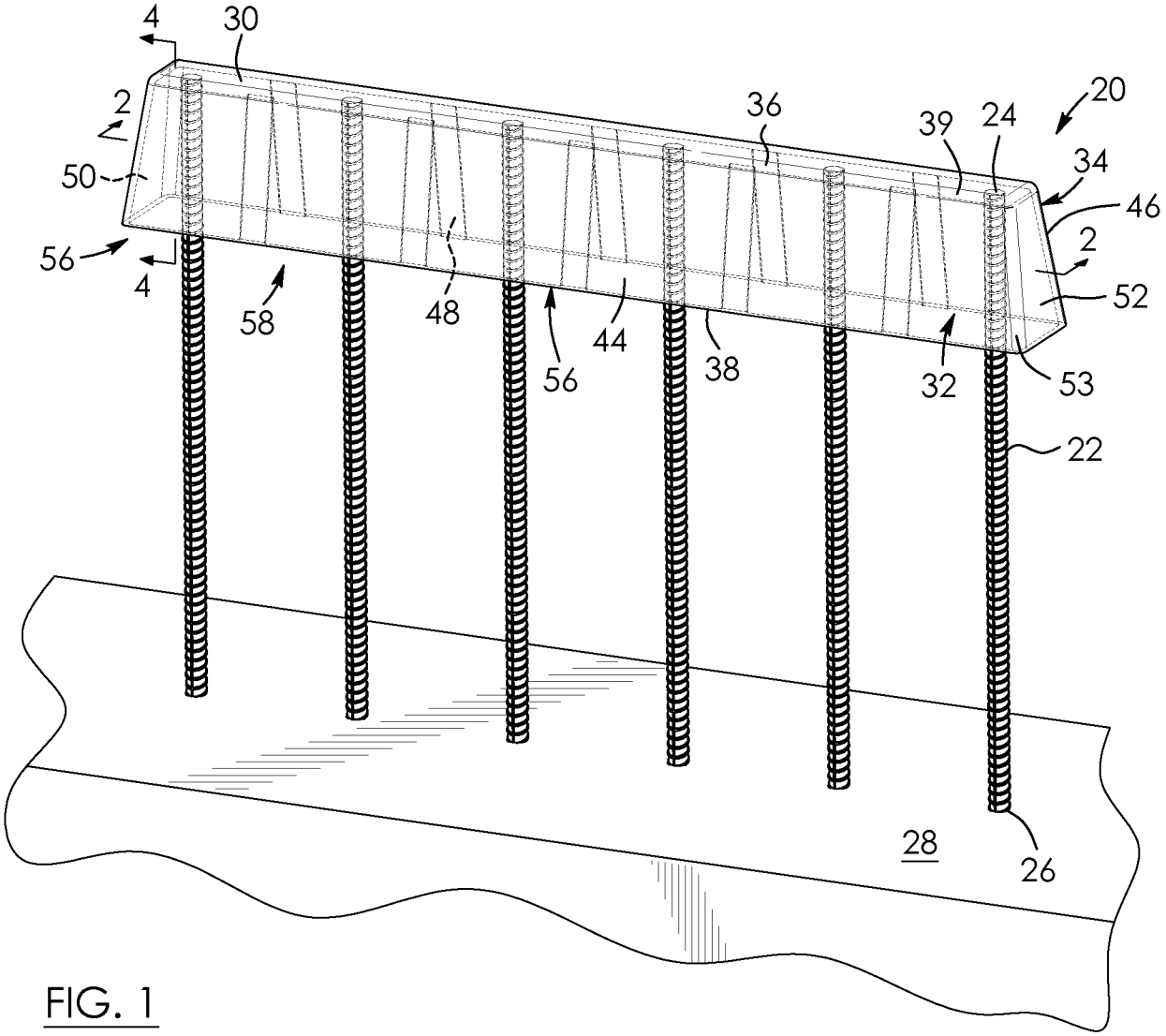
FIG. 1 is a top, side perspective view of an impalement prevention apparatus according to one aspect, shown extending around and overtop of the exposed ends of a plurality of spaced-apart bars.

Referring to the drawings and first to FIG. 1, there is shown an impalement prevention apparatus 20 for use with a plurality of spaced-part reinforcing bars 22 for concrete construction. Each bar has an exposed end 24 and a proximal end 26 which is spaced-apart from the exposed end. The proximal ends of the reinforcing bars are connected to a foundation, in this example a concrete foundation 28.

The apparatus 20 is made of recycled plastic, in this example polyethylene accordingly to one preferred aspect, though the apparatus can be made of other materials in other embodiments. The apparatus is in the form of a hollow housing and includes an elongate top portion 30 shaped to extend overtop of exposed ends 24 of the reinforcing bars 22. The top portion is rectangular in shape in this example. The apparatus 20 includes a pair of elongate spaced-apart side portions 32 and 34. The side portions are isosceles trapezoids in shape in this example. Each of the side portions has a proximal end and a distal end spaced-apart from the proximal end, as shown by proximal end 36 and distal end 38 for side portion 32. The proximal ends of the side portions 32 and 34 connect to the top portion 30 and extend downwards therefrom towards the proximal ends 26 of the reinforcing bars 22. The side portions connect to the top portion via rounded corners, as shown by rounded corner 39 extending along and between side portion 32 and top portion 30 in FIG. 4.

Figure 4:
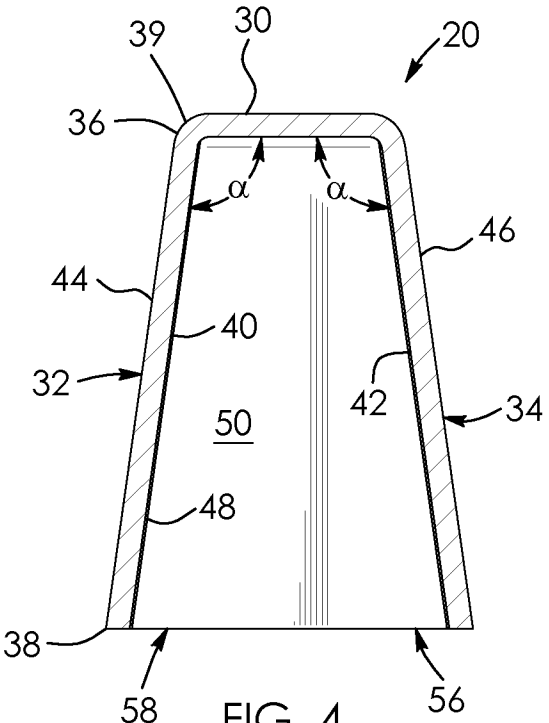
FIG. 4 is a sectional view taken along lines 4-4 of the apparatuses of FIG. 1.

As best seen in FIG. 4, each of the side portions 32 and 34 connects to and extends outwards from the top portion 30 at an obtuse angle α relative to the top portion in this example. Angles α are equal to each other in absolute value in this example and are equal to 100 degrees in this example, though this is not strictly required and the angles may be other values in other embodiments.

The side portions 32 and 34 have inner surfaces 40 and 42, respectively, which face each other. The side portions 32 and 34 also have outer surfaces 44 and 46, respectively, which are spaced-apart from the inner surfaces.

Figure 5:
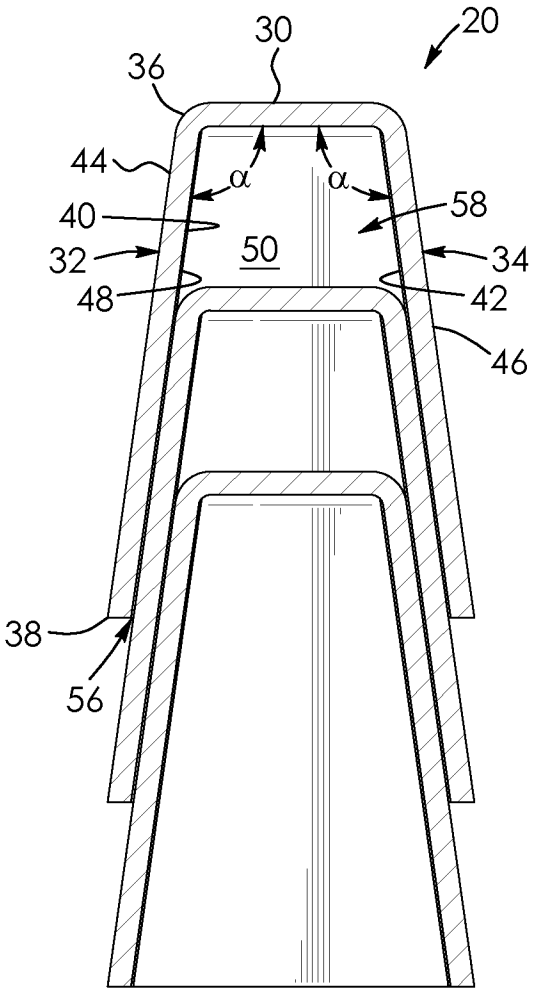
FIG. 5 is a sectional view similar to FIG. 4 of a plurality of the apparatus of FIG. 1 shown stacked together.

The apparatus 20 includes a plurality of stacking spacers, in this example, elongate strips 48. The strips are rectangular prisms in shape in this example. The strips 48 are connected to and spaced-apart along respective ones of the inner surfaces 40 and 42 of the side portions 32 and 34. Each strip extends from a respective one of the proximal ends of the side portions to a respective one of the distal ends of the side portions, as shown in FIG. 4 by strip 48 extending between ends 36 and 38. As seen in FIG. 1, the strips 48 are positioned to be interposable between respective ones of the reinforcing bars. The strips 48 provide spacing between respective side portions of a plurality of apparatuses 20 when the apparatuses are stacked together, as seen in FIG. 5. Thus, when the apparatus are wet, the strips inhibit the apparatus so stacked from sticking together.

The apparatus 20 includes a pair of spaced-apart end portions 50 and 52 each connecting to and extending between the side portions 32 and 34. The end portions are isosceles trapezoids in shape in this example, as best seen in FIG. 4 for end portion 50. The end portions connect to the side portion via rounded corners, as shown by rounded corner 53 extending along and between end portion 52 and side portion 32 in FIG. 1.

Figure 2:
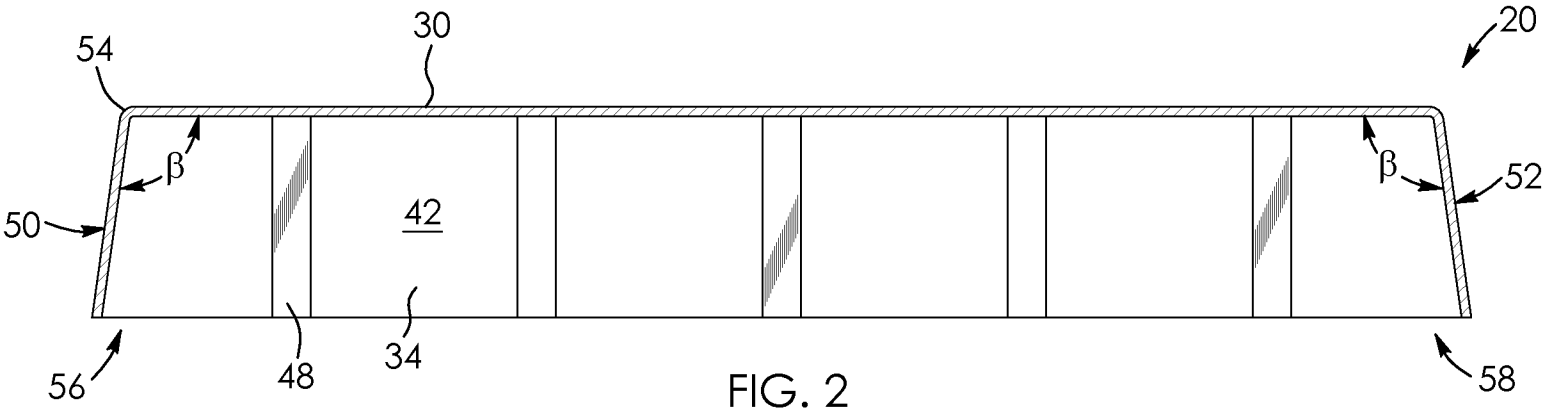
FIG. 2 is a sectional view taken along lines 2-2 of the apparatus of FIG. 1.
Figure 3:
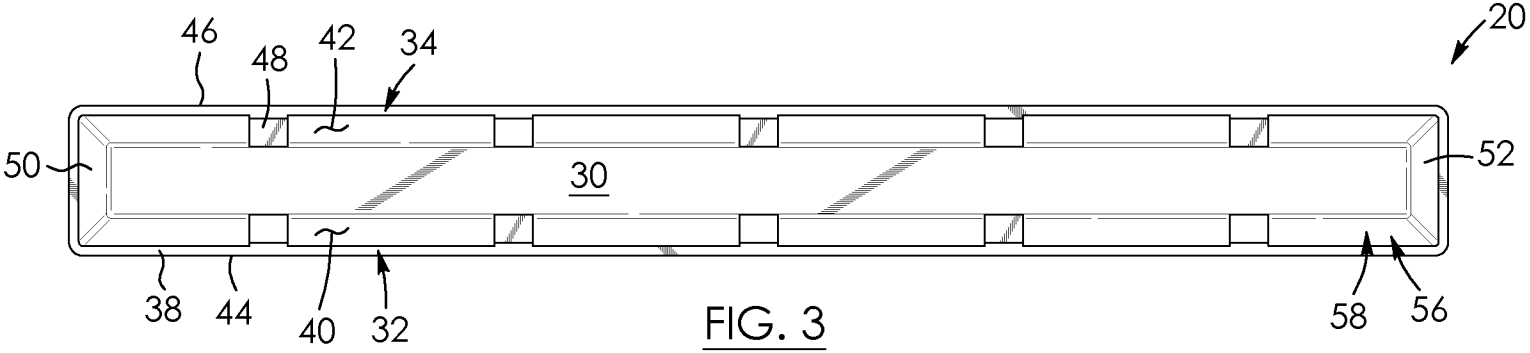
FIG. 3 is a bottom plan view of the apparatus of FIG. 1.

Referring to FIG. 2, each of the end portions 50 and 52 connects to and extends outwards from the top portion 30 at an obtuse angle β relative to the top portion in this example. Angles β are equal to each other in absolute value in this example. Angle β is equal to 100 degrees in this example, though this is not strictly required and may be a different value in other embodiments. The end portions connect to the top portion via rounded corners, as shown by rounded corner 54 extending along and between end portion 50 and top portion 30 in FIG. 2.

Referring back to FIG. 1, the apparatus 20 includes an open end 56 spaced-apart from the top portion 30. The open end is rectangular in shape in this example and is larger than the top portion in this example. In other words, the apparatus is outwardly tapered from the open end towards the top portion. The top portion 30, the side portions 32 and 34 and the end portions 50 and 52 form an enclosure 58 which is extendable around the exposed ends 24 of the reinforcing bars 22. The end portions are shaped to abut adjacent ones of the reinforcing bars when a person falls onto the apparatus 20 at an angle, thereby ensuring that the apparatus remains extended overtop of and around the exposed ends of the reinforcing bars. The apparatus 20 so shaped, with its rounded corners and outwardly protruding end portions and side portions, functions to absorb this falling impact in a manner that protects and minimizes injury to the falling person.

As seen in FIG. 5, the enclosure is further shaped to receive the side portions and the top portion of a further apparatus when stacking respective ones of the apparatuses together. This may allow the apparatuses 20 to be packed together in an efficient and cost-effective manner for storing and transporting purposes.

Figure 6:
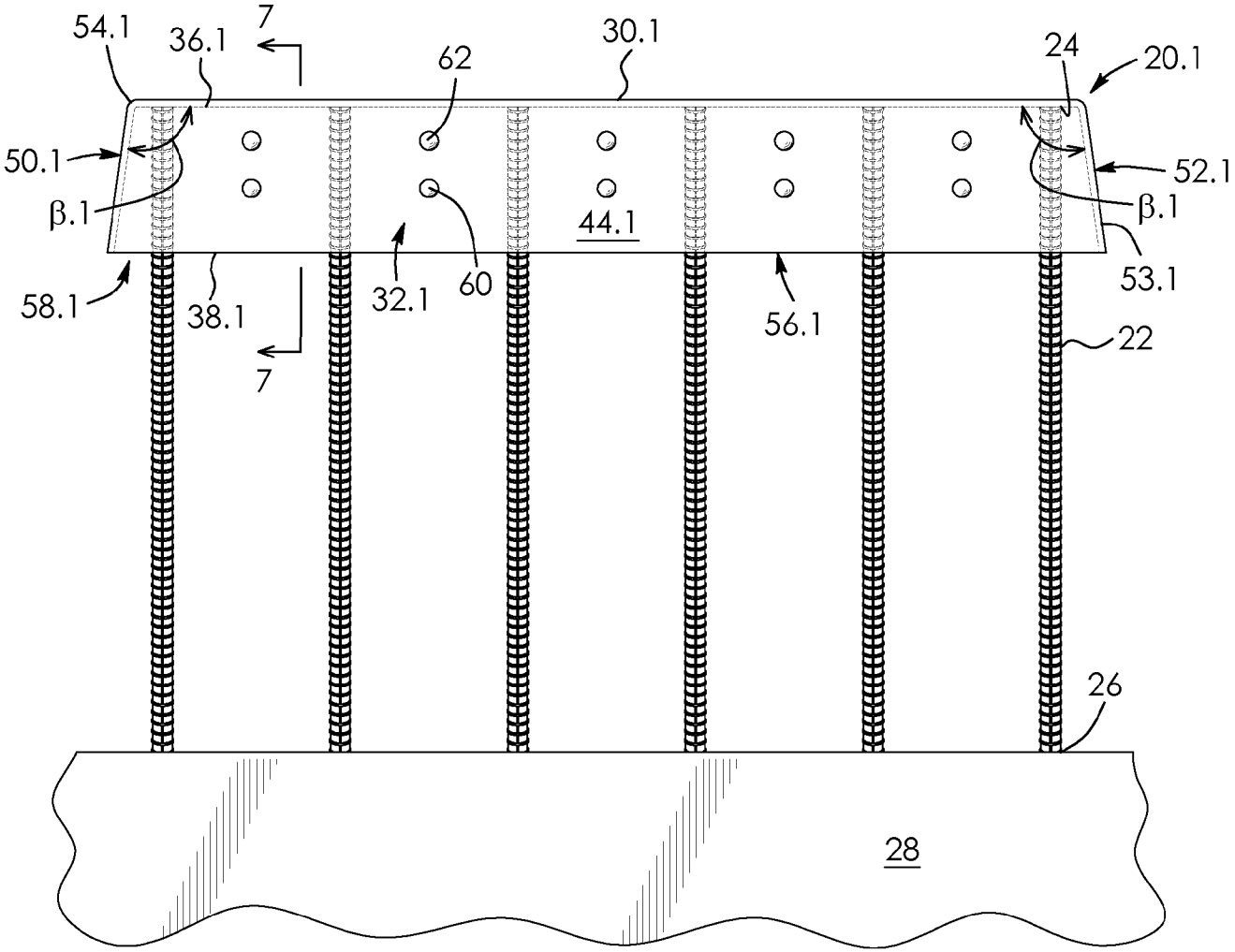
FIG. 6 is a side elevation view of an impalement prevention apparatus according to a second aspect, shown extending around and overtop of the exposed ends of a plurality of spaced-apart bars.
Figure 7:
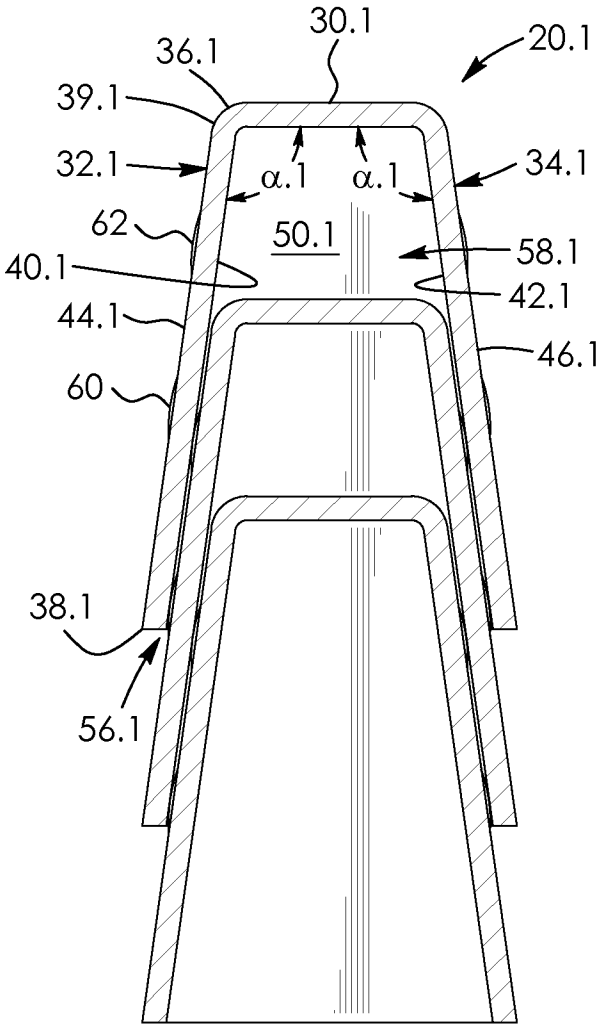
FIG. 7 is a sectional view similar to FIG. 5 of a plurality of the apparatuses of FIG. 6, shown in sectional view and shown stacked together.

FIGS. 6 and 7 show an impalement prevention apparatus 20.1 according to a second aspect. Like parts have like numbers and functions as the impalement prevention apparatus 20 shown in FIGS. 1 to 5 with the addition of ".1". Apparatus 20.1 is substantially the same as apparatus 20 shown in FIGS. 1 to 5 with the exception that the spacers are in the form of pairs of spaced-apart, partially-spherical, convexly curved protrusions in this example, as seen by protrusions 60 and 62. The protrusions connect to and extend outwards from the outer surfaces of the side portions, as seen by protrusions 60 and 62 connecting to and extending outwards from the outer surface 44.1 of side portion 32.1.

Figure 9:
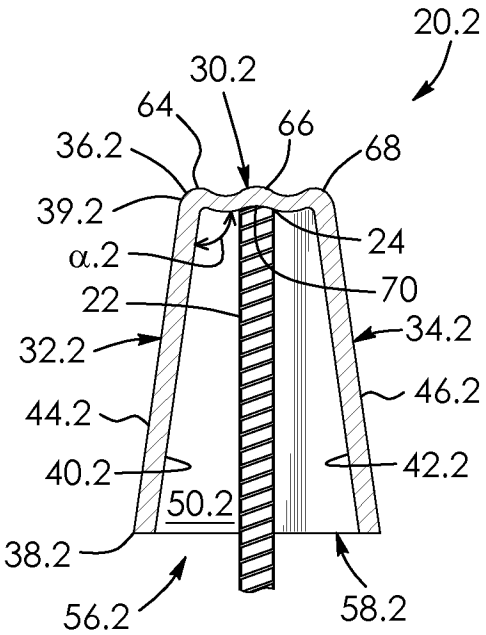
FIG. 9 is a sectional view similar to FIG. 5 of a plurality of the apparatuses of FIG. 8, shown in section stacked together.
Figure 8:
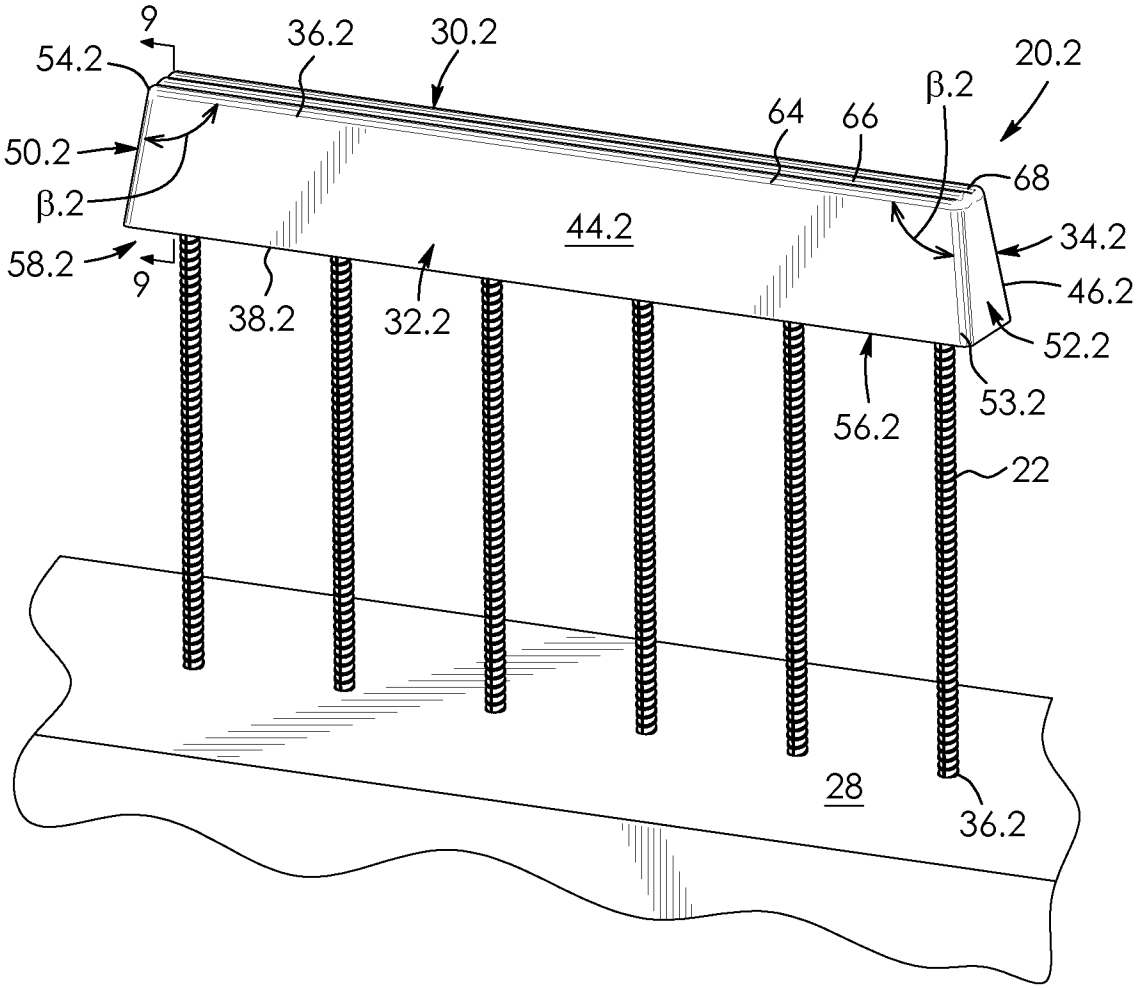
FIG. 8 is a top, side perspective view of an impalement prevention apparatus according to a third aspect, shown extending around and overtop of the exposed ends of a plurality of spaced-apart bars.

FIGS. 8 and 9 show an impalement prevention apparatus 20.2 according to a third aspect. Like parts have like numbers and functions as the impalement prevention apparatus 20 shown in FIGS. 1 to 5 with the addition of ".2". Apparatus 20.2 is substantially the same as apparatus 20 shown in FIGS. 1 to 5 with the following exceptions. Top portion 30.2 includes a plurality of space-apart elongate ribs, in this example three ribs 64, 66 and 68 as best seen in FIG. 9. The ribs may function to strengthen the top portion of the apparatus 20.2 in a manner that minimizes materials and weight. According to one preferred aspect, the apparatus 20.2 is injection moulded and by providing ribs 64, 66 and 68, top portion 30.2 may be made thinner, thereby facilitating the injection moulding process.

The top portion includes a central elongate groove 70 on the inner surface thereof which is shaped to receive respective ones of the exposed ends 24 of the reinforcing bars 22. The groove aligns adjacent to and parallel with central rib 66 in this example. The ribs 64, 66, and 68 are formed, in this example, by forming the top portion in a waved manner, with the groove 70 being also formed thereby.

FIGS. 10 to 15 show an impalement prevention apparatus 20.3 according to a fourth aspect. Like parts have like numbers and functions as the impalement prevention apparatus 20.2 shown in FIGS. 6 and 7 with decimal extension ".3" replacing decimal extension ".2". Apparatus 20.3 is substantially the same as apparatus 20.2 shown in FIGS. 6 and 7 with the following exceptions.

Figure 10:
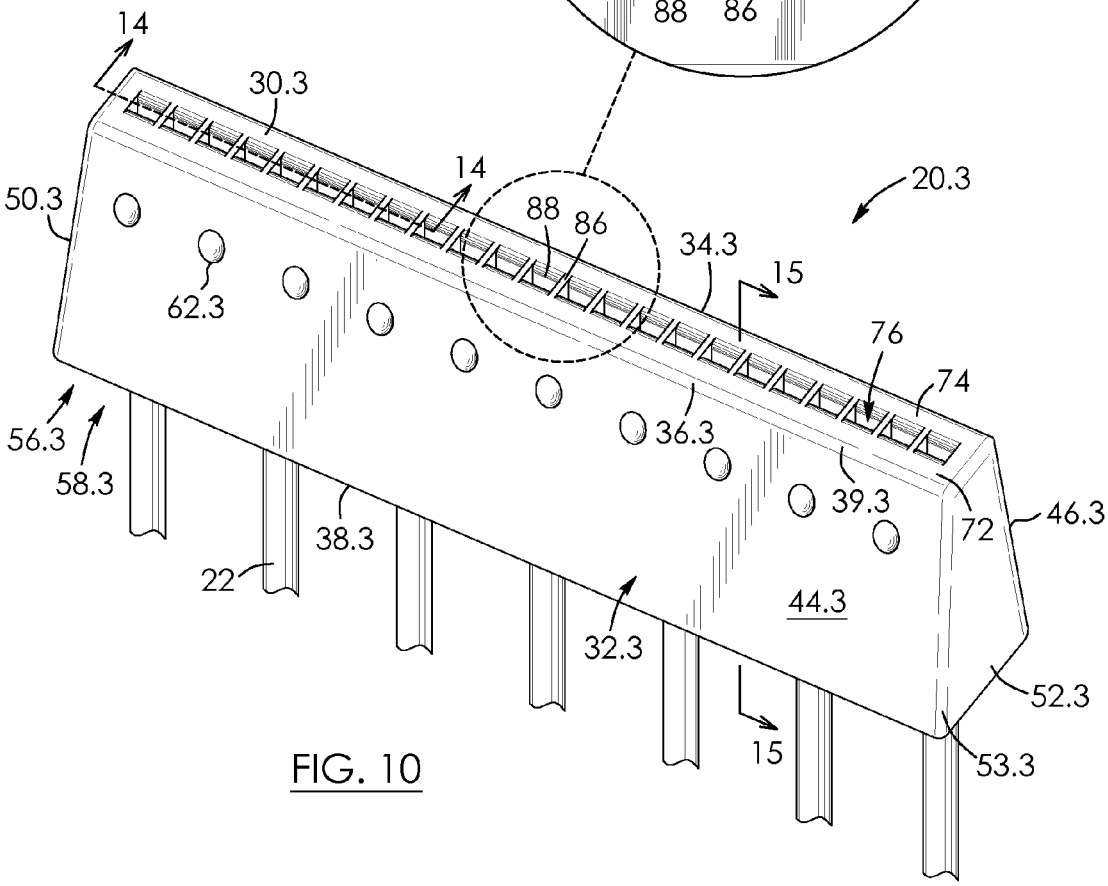
FIG. 10 is a top, side perspective view of an impalement prevention apparatus according to a fourth aspect.
Figure 12:
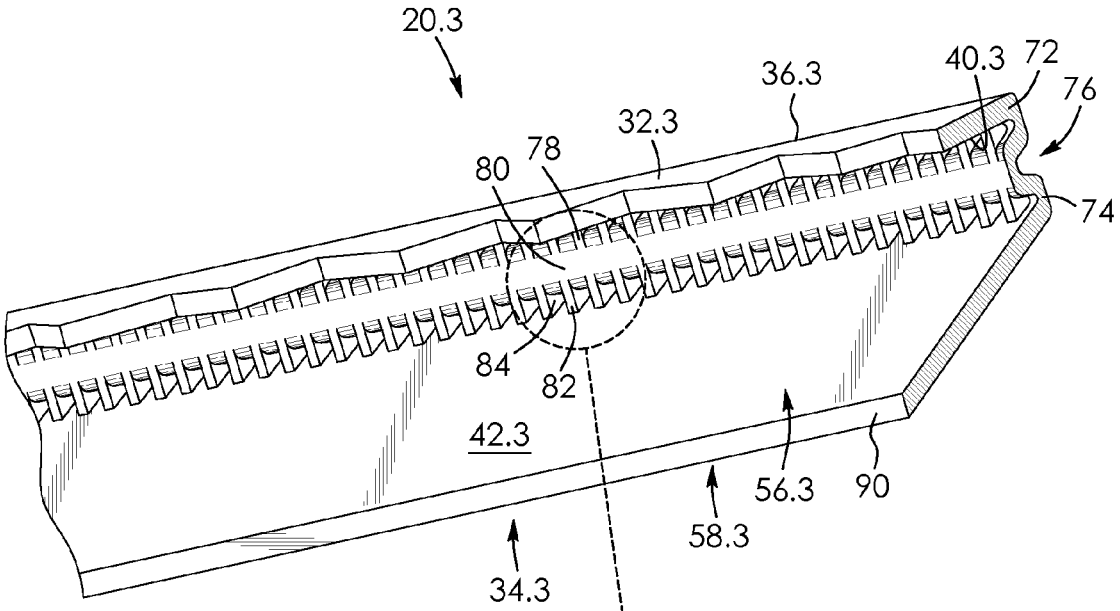
FIG. 12 is a bottom, side perspective view of the apparatus of FIG. 10, partially broken away.
Figure 15:
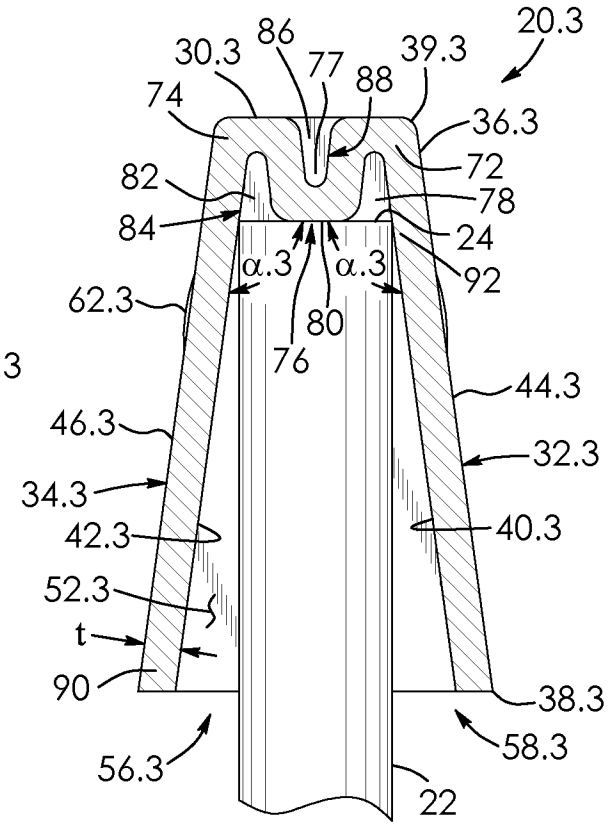
FIG. 15 is a side-sectional view of the apparatus of FIG. 10 taken along lines 15-15 of the apparatus of FIG. 10.

Top portion 30.3 of the apparatus 20.3 includes a pair of spaced-apart longitudinal ridges 72 and 74, best seen with reference to FIGS. 10, 12 and 15, positioned adjacent to respective ones of the side portions 32.3 and 34.3 of the apparatus 20.3. The ridges are flat-topped in this example though this is not strictly required. Top portion 30.3 includes an elongate trough 76, best seen in FIGS. 12 and 15, positioned between the ridges. The trough has a central depression 77 extending downwards from the top portion 30.3 of the apparatus. As seen in FIG. 10, ridges 72 and 74 and trough 76 connect to and extend between end portions 50.3 and 52.3 of the apparatus 20.3. Referring to FIG. 12, the trough extends downwards into enclosure 58.3 and is positioned between the side portions 32.3 and 34.3 of the apparatus 20.3.

Figure 13:
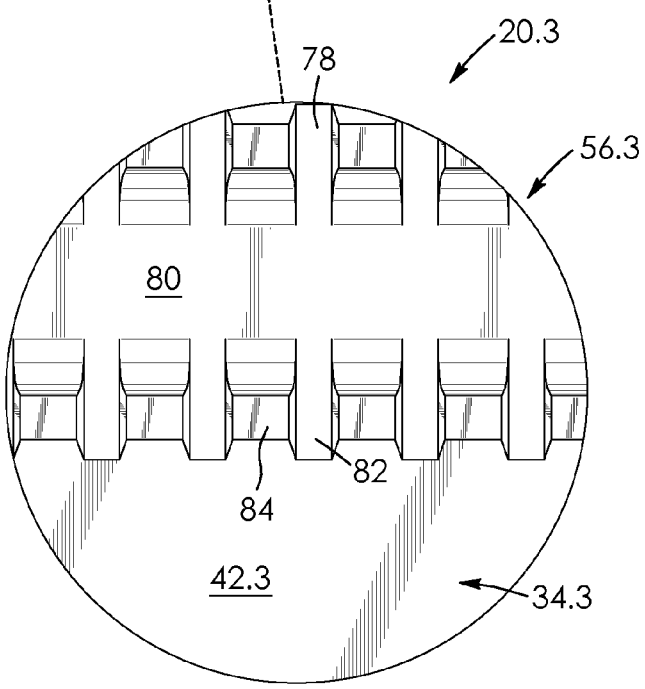
FIG. 13 is an enlarged bottom plan view of part of the top portion of the apparatus of FIG. 10.

As best seen in FIGS. 12, 13 and 15, the apparatus 20.3 includes a plurality of longitudinally spaced-apart webs that connect to and extend between each of the side portions of the apparatus and the trough. This is shown in FIG. 15 by web 78 extending between side portion 32.3 and trough 76, and web 82 extending between side portion 34.3 and trough 76. The webs thus connect to and extend between the side portions 32.3 and 34.3 of the apparatus. The webs 78 and 82 also connect to and extend downwards from the top portion 30.3 of the apparatus 20.3 to the bottom 80 of the trough 76. The webs are generally an inverted u-shape in this example as best seen in FIG. 15. As best seen in FIGS. 12 and 13, the apparatus 20.3 also includes a plurality of spaced-apart recesses 84 positioned between adjacent webs. The recesses are generally in the shape of triangular prisms in this example.

Figure 11:
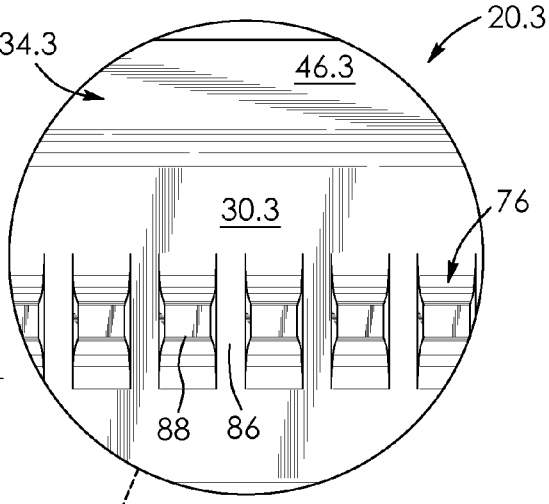
FIG. 11 is an enlarged top plan view of part of the top portion of the apparatus of FIG. 10.
Figure 14:
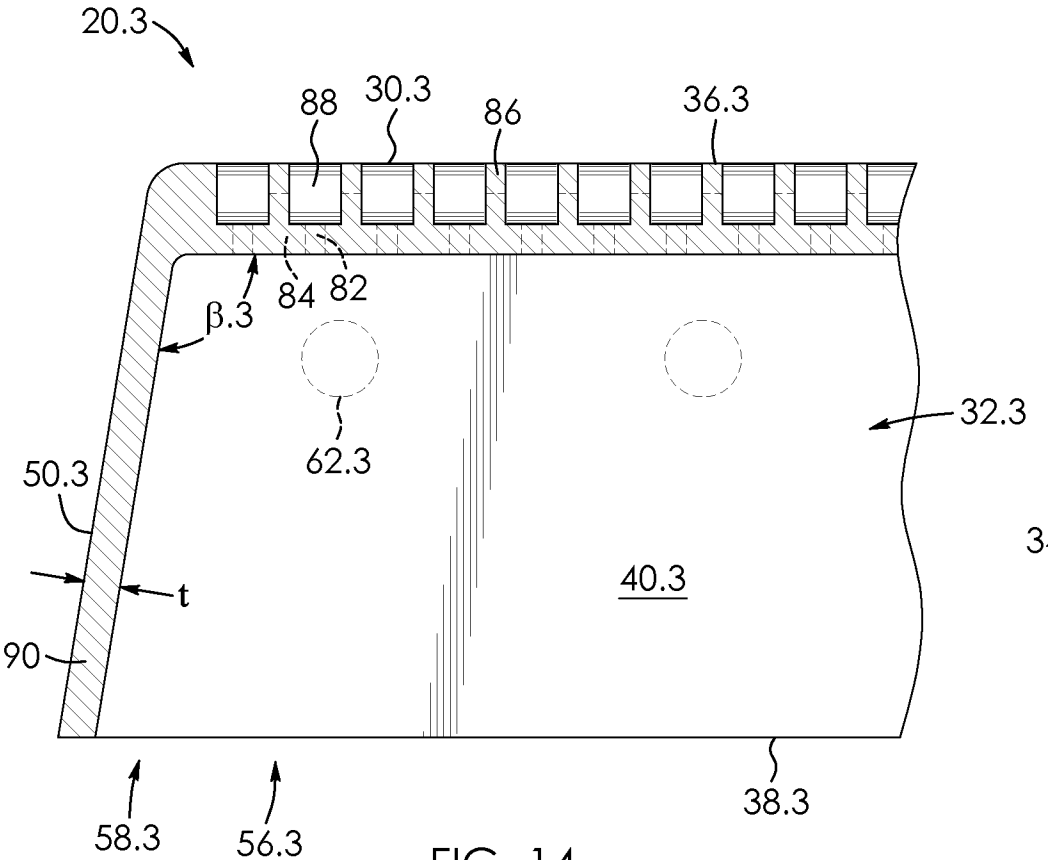
FIG. 14 is a cross-sectional view of the apparatus of FIG. 10 taken along lines 14-14 of the apparatus of FIG. 10.

Referring now to FIGS. 10, 11 and 15, the apparatus 20.3 includes a plurality of longitudinally spaced-apart, lateral ribs 86 positioned within the trough 76 and which connect to and extend between the ridges 72 and 74. The ribs are generally u-shaped in shape in this example as best seen in FIG. 15. As seen in FIG. 14, in this example, ribs 86 are longitudinally spaced-apart and interposed between webs 82. Referring back to FIG. 10, the apparatus 20.3 includes a plurality of spaced-apart recesses 88 positioned between respective ones of its ribs. The recesses are generally in the shape of triangular prisms in this example with square outer ends.

Side portions 32.3 and 34.3, top portion 30.3 and end portions 50.3 and 52.3 of the apparatus 20.3 are formed by sheet members 90 of substantially the same thickness t, as best seen in FIGS. 14 and 15. The apparatus 20.3 so shaped, with its ridges and trough, enables the apparatus to be molded in an efficient manner that inhibits warping, while also providing an effectively thicker and stronger top portion 30.3. Webs 78 and 82 and ribs 86 further enhance the weight-bearing strength of top portion 30.3. Also, the webs and ribs, together with recesses 84 and 88 and sheet members 90 of the same thickness, promotes effective forming of the apparatus and subsequent cooling during its manufacture.

As seen in FIG. 15, apparatus 20.3 in this example is shaped to snugly receive the exposed ends 24 of the reinforcing bars 22 between the side portions 32.3 and 34.3 of the apparatus. In this case, the ends of the reinforcing bars are fitted between the side portions of the apparatus at a location 92 which is adjacent to where the side portions of the apparatus connect with the top portion 30.3 of the apparatus.

Figure 17:
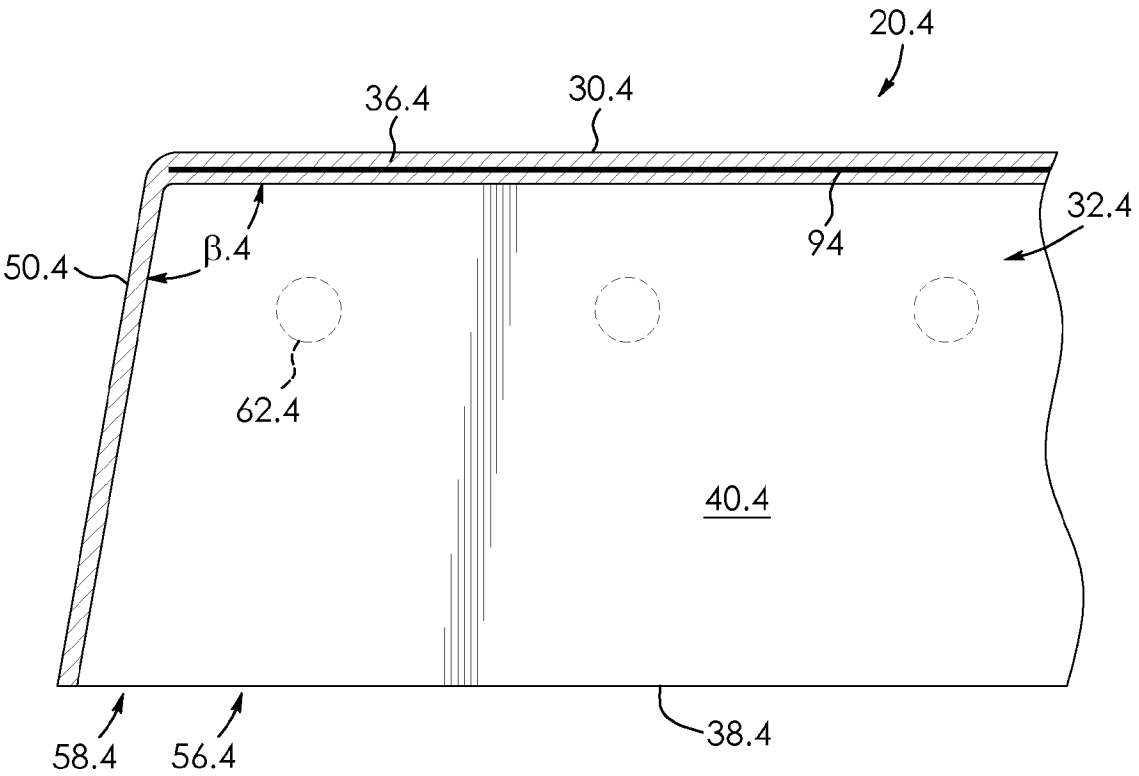
FIG. 17 is a side-sectional view similar to FIG. 15 of the apparatus of FIG. 16.
Figure 16:
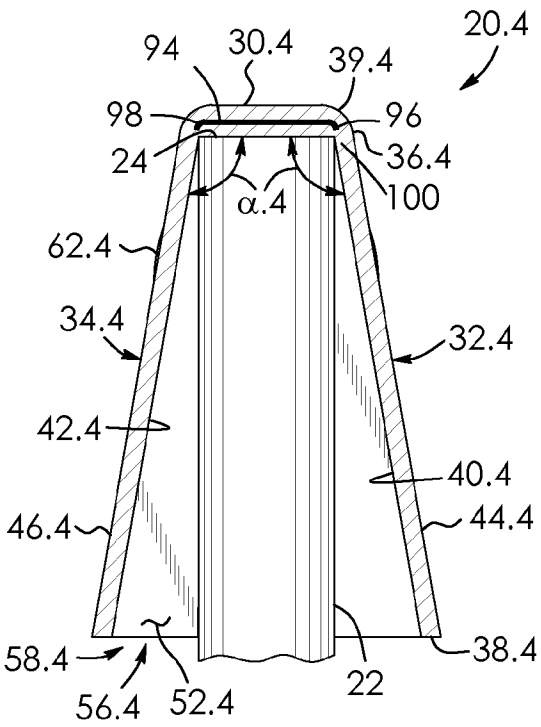
FIG. 16 is a cross-sectional view similar to FIG. 14 of an impalement prevention apparatus according to a fifth aspect.

FIGS. 16 and 17 show an impalement prevention apparatus 20.4 according to a fifth aspect. Like parts have like numbers and functions as the impalement prevention apparatus 20 shown in FIGS. 1 to 5 with the addition of decimal extension ".4". Apparatus 20.4 is substantially the same as apparatus 20 shown in FIGS. 1 to 5 with the following exceptions.

Apparatus 20.4 is primarily made of plastic, in this example polyethylene, though this is not strictly required and other materials may be used. The apparatus in this embodiment further includes a strengthening plate, in this example a metal plate 94, of steel in this example, connected to and extending along the top portion 30.4 of the apparatus. The plate is embedded within the top portion of the apparatus in this example. Plate 94 includes a pair of spaced-apart curved longitudinal edge portions 96 and 98 in this example which abut with and are embedded within side portions 96 and 98 of the apparatus 20.4, respectively, adjacent to corners 39.4 of the apparatus, the plate 94 thus being a u-shaped channel as seen in FIGS. 16 and 17.

As seen in FIG. 16, ends 24 of the reinforcing bars 22 are snugly received between side portions 32.4 and 34.4 of the apparatus 20.4 at a location 100 adjacent to where the side portions of the apparatus connect with the top portion 30.4 of the apparatus.

Figure 18:
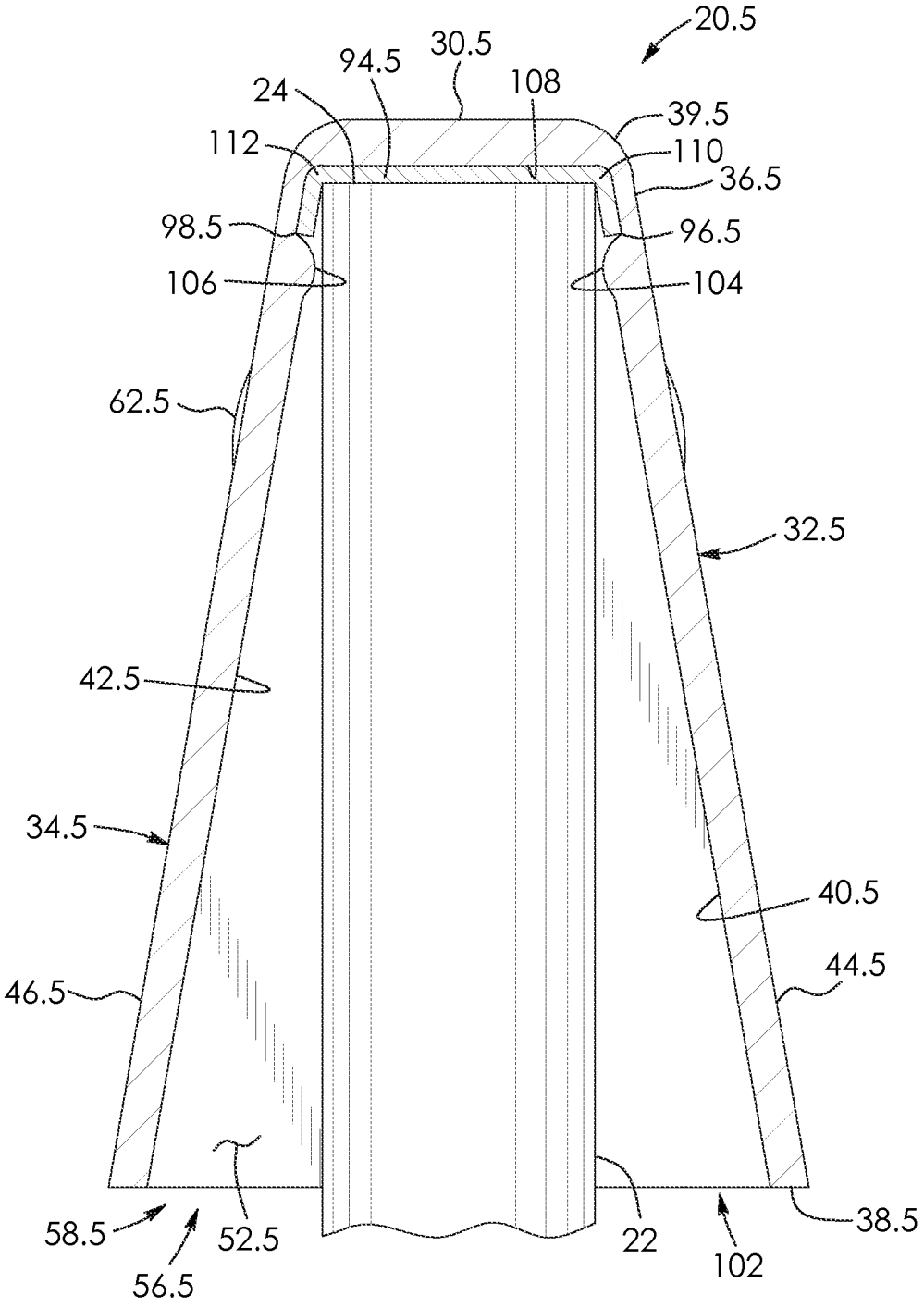
FIG. 18 is a cross-sectional view similar to FIG. 16 of an impalement prevention apparatus according to a sixth aspect.

FIG. 18 shows an impalement prevention apparatus 20.5 according to a sixth aspect. Like parts have like numbers and functions as the impalement prevention apparatus 20.4 shown in FIGS. 16 and 17 with decimal extension ".5" replacing decimal extension ".4" and being added for numerals not previously having a decimal extension. Apparatus 20.5 is substantially the same as apparatus 20.4 shown in FIGS. 16 and 17 with the following exceptions.

The apparatus has an interior 102 and further includes a pair of spaced-apart protrusions 104 and 106 positioned within the interior of the apparatus. The protrusions are longitudinally extending in this example, extending between the end portions of apparatus, though this is not strictly required. Protrusion 104 extends outwards from inner surface 40.5 of side portion 32.5 of the apparatus 20.5 and protrusion 106 extends outwards from inner surface 42.5 of side portion 34.5 of the apparatus. The protrusions are positioned adjacent to and spaced-apart from the top portion 30.5 of the apparatus 20.5 Plate 94.5 abuts inner surface 108 of top portion 30.5 of the apparatus 20.5. The plate is retained in place between the top portion of the apparatus and the protrusions 104 and 106. In one example, plate 94.5 is installed by being pushed past protrusions 104 and 106 and towards inner surface 108 of top portion 30.5 of the apparatus when the apparatus has recently come out of the mold and is thus still malleable, with the plate thus being pressed or snapped into place. Edge portions 96.5 and 98.5 of the plate abut protrusions 104 and 106, respectively, when the plate is so positioned in place and, as seen in FIG. 18, the plate is bent out of plane longitudinally at portions 110 and 112 towards the pair of spaced-apart longitudinal edge portions 96.5 and 98.5 such that the bent portions 110 and 112 of the strengthening plate run along both the sides portions 32.5 and 34.5 of the apparatus from the bent portions to the edge portions and extend over the exposed ends 24 of the bars 22. Also as seen in FIG. 18, longitudinal edge portions 96.5 and 98.5 of the plate 94.5 extend in parallel with respective ones of the side portions 32.5 and 34.5 of the apparatus 20.5 in this example.

The top portion, side portions and end portions of the various embodiments of the apparatus described herein may be referred to as a means for forming an enclosure extendable around the exposed ends of the bars.

It will be appreciated that many variations are possible within the scope of the invention described herein. It will be understood by someone skilled in the art that many of the details provided above are by way of example only and are not intended to limit the scope of the invention which is to be determined with reference to at least the following claims.

What is claimed is:

1. In combination, a plurality of spaced-part reinforcing bars having exposed ends and an impalement prevention apparatus for use with said plurality of spaced-part reinforcing bars, the apparatus comprising:

an elongate top portion shaped to extend over the exposed ends of the bars;

a pair of elongate, spaced-apart side portions connecting to the top portion and extending downwards therefrom, the side portions extending outwards from the top portion at obtuse angles relative to the top portion;

an open end spaced-apart from the top portion, the open end being larger than the top portion;

a pair of spaced-apart end portions connecting to and extending between the side portions, the end portions further connecting to and extending outwards from the top portion at obtuse angles relative to the top portion, an enclosure being formed by the top portion, the side portions and the end portions so connected together, the enclosure being extendable over the exposed ends of the bars; and a strengthening plate connected to and extending along said top portion, the plate having a pair of spaced-apart longitudinal edge portions which abut with respective ones of the side portions, the plate being bent out of plane longitudinally at portions towards said pair of spaced-apart longitudinal edge portions such that the bent portions of the strengthening plate run along both the sides portions of the apparatus from the bent portions to the edge portions and extend over the exposed ends of the bars.

2. The combination as claimed in claim 1 wherein the apparatus includes a hollow housing, the housing being tapered in a direction extending away from the ends of the bars.

3. The combination as claimed in claim 1 wherein the end portions are isosceles trapezoids in shape and wherein the side portions are isosceles trapezoids in shape.

4. The combination as claimed in claim 1 wherein the top portion has an elongate groove shaped to receive respective ones of the exposed ends of the bars.

5. The apparatus as claimed in claim 1 wherein the top portion includes a plurality of space-apart elongate ribs.

6. The combination as claimed in claim 1 further including a plurality of stacking spacers connected to and spaced along the side portions thereof, the spacers providing spacing between the side portions of the apparatus and side portions of a further said apparatus when the apparatuses are stacked together.

7. The combination as claimed in claim 6 wherein the side portions have proximal ends connected to the top portion and distal ends spaced-apart from the proximal ends and wherein the spacers are elongate strips extending from the proximal ends of the side portions to the distal ends of the side portions.

8. The apparatus as claimed in claim 1 further including a plurality of spaced-apart webs connected to and extending between the side portions of the apparatus.

9. The apparatus as claimed in claim 8 wherein the webs are longitudinally spaced-apart and connect to and extend downwards from the top portion of the apparatus.

10. The combination as claimed in claim 1, the apparatus being shaped to snugly receive the exposed ends of the bars between the side portions of the apparatus at locations adjacent to where the side portions of the apparatus connect with the top portion of the apparatus.

11. The combination as claimed in claim 1 wherein the side portions, the top portion and the end portions of the apparatus are formed by sheet members of substantially equal thickness.

12. The apparatus as claimed in claim 1 wherein the top portion includes a pair of spaced-apart longitudinal ridges which are adjacent to respective ones of the side portions of the apparatus and wherein the top portion includes an elongate trough positioned between the ridges, the trough extending downwards and being positioned between the side portions of the apparatus.

13. The apparatus as claimed in claim 12 further including a plurality of spaced-apart webs that connect to and extend between respective ones of the side portions of the apparatus and the trough.

14. The apparatus as claimed in claim 12 further including a plurality of longitudinally spaced-apart lateral ribs positioned within the trough, the lateral ribs connecting to and extending between the ridges.

15. The combination as claimed in claim 1, wherein the top portion, the side portions and the end portions of the apparatus are made of plastic and wherein the strengthening plate is made of metal.

16. The apparatus as claimed in claim 15 wherein the strengthening plate is a metal plate embedded within the top portion of the apparatus.

17. The combination as claimed in claim 1, the apparatus having an interior and further including a pair of spaced-apart protrusions positioned within the interior of the apparatus, the protrusions extending outwards from respective ones of the side portions of the apparatus, and wherein the strengthening plate is interposed between and retained in place by the protrusions and the top portion of the apparatus.

18. The combination as claimed in claim 6 wherein the side portions have proximal ends connected to the top portion and distal ends spaced-apart from the proximal ends and wherein the spacers are partially-spherical protrusions.

19. The combination as claimed in claim 1 wherein the strengthening plate is a u-shaped channel.

20. The combination as claimed in claim 1 wherein the longitudinal edge portions of the plate extend in parallel with respective ones of the side portions of the apparatus.

* * * * *

UNITED STATES PATENT AND TRADEMARK OFFICE

CERTIFICATE OF CORRECTION

PATENT NO. : 9,133,636 B2
APPLICATION NO. : 14/071389
DATED : September 15, 2015
INVENTOR(S) : Phil Hewlett and Jim MacLean It is certified that error appears in the above-identified patent and that said Letters Patent is hereby corrected as shown below:

In the Claims,

Column 6, line 41 to column 7, line 3 should read,
1. In combination, a plurality of spaced-apart reinforcing bars having exposed ends and an impalement prevention apparatus for use with said plurality of spaced-apart reinforcing bars, the apparatus comprising:
an elongate top portion shaped to extend over the exposed ends of the bars;
a pair of elongate, spaced-apart side portions connecting to the top portion and extending downwards therefrom, the side portions extending outwards from the top portion at obtuse angles relative to the top portion;
an open end spaced-apart from the top portion, the open end being larger than the top portion;
a pair of spaced-apart end portions connecting to and extending between the side portions, the end portions further connecting to and extending outwards from the top portion at obtuse angles relative to the top portion, an enclosure being formed by the top portion, the side portions and the end portions so connected together, the enclosure being extendable over the exposed ends of the bars; and
a strengthening plate connected to and extending along said top portion, the plate having a pair of spaced-apart longitudinal edge portions which abut with respective ones of the side portions, the plate being bent out of plane longitudinally at portions towards said pair of spaced-apart longitudinal edge portions such that the bent portions of the strengthening plate run along both the sides portions of the apparatus from the bent portions to the edge portions and extend over the exposed ends of the bars.

Column 7, lines 14-15 should read,
5. The combination as claimed in claim 1 wherein the top portion includes a plurality of spaced-apart elongate ribs.

Column 7, lines 27-29 should read,
8. The combination as claimed in claim 1 further including a plurality of spaced-apart webs connected to and extending between the side portions of the apparatus.

Signed and Sealed this
Fifteenth Day of December, 2015

Michelle K. Lee

Michelle K. Lee
*Director of the United States Patent and Trademark Office*

Column 7, lines 30-32 should read,
9. The combination as claimed in claim 8 wherein the webs are longitudinally spaced-apart and connect to and extend downwards from the top portion of the apparatus.

Column 8, lines 1-7 should read,
12. The combination as claimed in claim 1 wherein the top portion includes a pair of spaced-apart longitudinal ridges which are adjacent to respective ones of the side portions of the apparatus and wherein the top portion includes an elongate trough positioned between the ridges, the trough extending downwards and being positioned between the side portions of the apparatus.

Column 8, lines 8-11 should read,
13. The combination as claimed in claim 12 further including a plurality of spaced-apart webs that connect to and extend between respective ones of the side portions of the apparatus and the trough.

Column 8, lines 12-15 should read,
14. The combination as claimed in claim 12 further including a plurality of longitudinally spaced-apart lateral ribs positioned within the trough, the lateral ribs connecting to and extending between the ridges.

Column 8, lines 20-22 should read,
16. The combination as claimed in claim 15 wherein the strengthening plate is a metal plate embedded within the top portion of the apparatus.